United States Patent [19]

Alford

[11] Patent Number: 5,036,771

[45] Date of Patent: Aug. 6, 1991

[54] LINEAR CUTTING CHARGE AND KIT-OF-PARTS FOR MAKING SAME

[76] Inventor: Sidney C. Alford, 41A Pickwick, Corsham, Wiltshire SN13 OHX, England

[21] Appl. No.: 470,755

[22] Filed: Jan. 26, 1990

[30] Foreign Application Priority Data

Jul. 27, 1988 [GB] United Kingdom ..... 8817913.0

[51] Int. Cl.[5] ..... F42B 1/02; F42B 1/036

[52] U.S. Cl. ..... 102/307; 102/701

[58] Field of Search ..... 102/306, 307, 476, 701; 89/1.15; 175/4.6

[56] References Cited

U.S. PATENT DOCUMENTS

| | | | |
|---|---|---|---|
| 2,543,057 | 2/1951 | Porter | 102/307 |
| 2,587,243 | 2/1952 | Sweetman | 102/307 |
| 3,185,089 | 5/1965 | Parkhurst et al. | 102/307 |
| 3,374,737 | 3/1968 | Pike | 102/307 |
| 4,641,581 | 2/1987 | Weickert et al. | 102/307 |
| 4,815,384 | 3/1989 | Ringel et al. | 102/307 |

FOREIGN PATENT DOCUMENTS

| | | |
|---|---|---|
| 0278233 | 8/1988 | European Pat. Off. . |
| 2060836 | 5/1981 | United Kingdom . |

*Primary Examiner*—David H. Brown

*Attorney, Agent, or Firm*—Finnegan, Henderson, Farabow, Garrett & Dunner

[57] ABSTRACT

The invention provides a kit-of-parts for assembling to form a linear cutting charge. The kit-of-parts comprises a plurality of elongate planar members (1), connecting means (3) for connecting the planar members (1) to form a box-like structure (2), a liner (9) and locating means (4) for locating said liner (9) within the box-like structure (2) to provide a space (10) on one side of the liner (9) for receiving an explosive material and a stand-off space (11) on the other side of the liner (9).

33 Claims, 2 Drawing Sheets

LINEAR CUTTING CHARGE AND KIT-OF-PARTS FOR MAKING SAME

This invention relates to linear cutting charges and more particularly to a kit-of-parts for assembling to form a linear cutting charge.

Known linear cutting charges are of two main types. One type comprises a metal tube, usually lead, copper or aluminium, which is filled with powdered explosive material and is then formed by rolling, pressing or drawing to compact the powdered explosive material and to form a longitudinal groove having planar side-walls at an angle to one another in the metal tube, that part of the metal tube having the groove therein constituting a liner and producing a fast-moving metal "jet" when the linear cutting charge is detonated.

Since it is necessary to allow a "stand-off" space between the said groove and the target in order for the fast-moving metal "jet" to form, it is usually necessary to provide such a linear cutting charge with means, such as side-walls, for locating the charge relative to the surface of a target. The formation of the "jet" is inhibited by the presence of solid or liquid material between the groove and the target, i.e. in the "stand-off" space, and accordingly a linear cutting charge of this type can only function under water if provided with means for excluding water from said space and this greatly complicates the use of such linear cutting charges under water.

Another disadvantage with linear cutting charges of this type is that because the metal tube is formed around the explosive material, the whole structure must be treated for the purposes of classification, storage and transport as explosive even though the actual explosive material may comprise only a small part of the total weight of the linear cutting charge. Also, although only that part of the metal case comprising said groove contributes directly to the cutting effect of the linear cutting charge, the remainder of the metal case which serves only to contain and confine the explosive material can result in the projection of very fast and dangerous high-velocity fragments upon detonation and this danger limits the usefulness of this type of linear cutting charge. Yet a further disadvantage of this type of linear cutting charge is that of necessity it is manufactured in standard lengths, usually two metre lengths, and needs to be cut into lengths appropriate to particular applications. This involves the sawing or shearing of metal in intimate contact with relatively easily initiated explosive materials and there is, in consequence, a significant danger of accidental detonation of the explosive material. This danger is so real that some manufacturers recommend that linear cutting charges of this type either be cut by remotely-controlled equipment or be ordered in pre-cut lengths, either of which suggestions is extremely impracticable to most users.

Another commonly known type of linear cutting charge comprises a box-like metal casing, usually of mild steel or aluminium which is divided longitudinally into two chambers by means of a V-section liner, with one of said chambers containing the explosive material and the other providing the required stand-off space. Such linear cutting charges are expensive to manufacture, particularly because of the amount of welding which is usually required, there often being as many as seven longitudinal welds in the finished casing. For use in deep water, the welded seams have to be completely intact since even a single tiny perforation in a welded seam can permit the ingress of water which can render the charge useless. Moreover, the leaking of explosive material between metal components of such a linear cutting charge can render the charge liable to accidental detonation if handled roughly.

Another disadvantage is that it is quite impracticable, and would be extremely hazardous, to attempt to cut linear cutting charges of this type to a required length with the result that such charges are generally either manufactured in a range of sizes or to order. Thus, only if the user's requirements are known precisely in advance, is it possible to obtain a linear cutting charge appropriate to a particular cutting operation. The alternative is to use the most appropriate of whatever charges are to hand, regardless of whether they are too powerful, too long, underpowered, or too short.

The above considerations, as well as the disadvantages of fragment projection and high cost, greatly limit the application of such known linear cutting charges.

The present invention has as its object to provide a kit-of-parts for assembly to form a linear cutting charge which will overcome some or all of the aforesaid disadvantages.

The present invention provides a kit-of-parts for assembling to form a linear cutting charge, comprising a plurality of elongate planar members, means for connecting said planar members to form a box-like structure a liner and means for locating said liner within said box-like structure to provide a space on one side of the liner for receiving an explosive material and a stand-off space on the other side of the liner element.

Said elongate planar members may comprise strips of metal, wood or plastics material.

Said connecting means may comprise angle pieces adapted to engage the adjacent side margins of adjacent planar members when forming said box-like structure or may comprise angle pieces formed integrally with a side margin of at least some of said planar members and adapted to engage an adjacent side margin of an adjacent planar member when forming said box-like structure. Said angle pieces may be elongate and be of a length to extend over substantially the whole of the length of the planar members. Preferably, said angle pieces each comprise at least one slot adapted to receive a side margin of a said planar member. Where the angle pieces are separate from the planar members then each angle piece may comprise two slots at right angles to one another and adapted to receive the adjacent side margins of adjacent planar members. The side margins of the planar members may be a close fit in said slots and may be sealingly securable in said slots as by bonding, e.g. using a suitable adhesive, welding or heat sealing.

According to an embodiment of the invention, at least one of said planar members comprises at least one integral hinge extending along the length thereof and providing said connecting means. Said integral hinge may be provided by a groove or opposed grooves in said planar member which locally reduces the thickness of the planar member. Preferably said planar member has a plurality of parallel integral hinges extending along the length thereof and the planar member has a substantially nonelastic film or foil, e.g. a plastics film or metal foil, on one or both surfaces thereof which prevents the planar member folding about any of said integral hinges until the film or foil has been slit along a said integral hinge. This enables any selected integral hinge or hinges to be used as required. In addition the planar member can be cut along a said integral hinge to obtain a planar member of a required width if the planar member was originally of too great a width.

Said liner may comprise an elongate angle-section element, e.g. a right-angle-section element, or a hollow tubular element, e.g. of round or square cross-section.

Said locating means may comprise rib means adapted to extend inwardly of the assembled box-like structure on opposite sides thereof. Each said locating means may comprise rib means adapted to extend inwardly of the box-like structure at an angle, e.g. right angles, to one another. The rib means of each locating means may comprise slots adapted to receive the side margins of an elongate angle-section liner and the ribs of each locating means may comprise slots of different width for receiving elongate angle-section liners of different thickness. Preferably, said locating means each comprise means, such as opposed slots, for connecting two said planar members edge-to-edge. Thus, each said locating means may be substantially in the form of a letter K in cross-section. It will be understood, however, that if desired the locating means could be formed integrally with at least two of said planar members.

Said planar members, said connecting means, said liner and said locating means may be produced in standard lengths which can be cut to a required length before the box-like structure is assembled and/or before the explosive material is inserted therein. This enables linear cutting charges of a required size and explosive capability to be readily and safely assembled on site and so avoids many of the disadvantages of the known types of linear cutting charge.

The kit-of-parts may further comprise closure means for closing the ends of the assembled box-like structure. Such closure means may comprise end caps and such end caps may have peripheral grooves for receiving end margins of said planar members. Said end caps may also comprise plug portions for sealing the ends of a said tubular liner and/or means for supporting a detonator.

Magnetic means may be provided for attaching the assembled linear cutting charge to a ferrous target. Such magnetic means may comprise a strap, preferably an elastically resilient strap, having a permanent magnet at each end thereof, said strap being extendable over the assembled linear cutting charge and the magnets being attachable to the target on either side of the linear cutting charge to firmly hold the linear cutting charge against the target. Said strap may be attachable to a top wall of the assembled box-like structure, as by means of a pop rivet or the like. Magnetic means comprising a strap as aforesaid has advantages over magnets attached directly to the box-like structure since such a magnetic means can more readily be adapted to a target having an uneven surface.

The present invention further provides a linear cutting charge when assembled from a kit-of-parts according to the present invention.

The invention further provides a method of forming a linear cutting charge comprising the steps of forming a box-like structure from a kit-of-parts according to the present invention, locating a liner in said box-like structure using said locating means and inserting explosive material into said space on said one side of the liner.

Said space on said one side of said liner may be left open until said explosive material has been inserted therein and may then be closed by a said planar member.

The invention will be more particularly described with reference to the accompanying drawings in which:

FIG. 1 is an end elevation of a linear cutting charge assembled from a kit-of-parts according to the present invention;

Figure 1A:
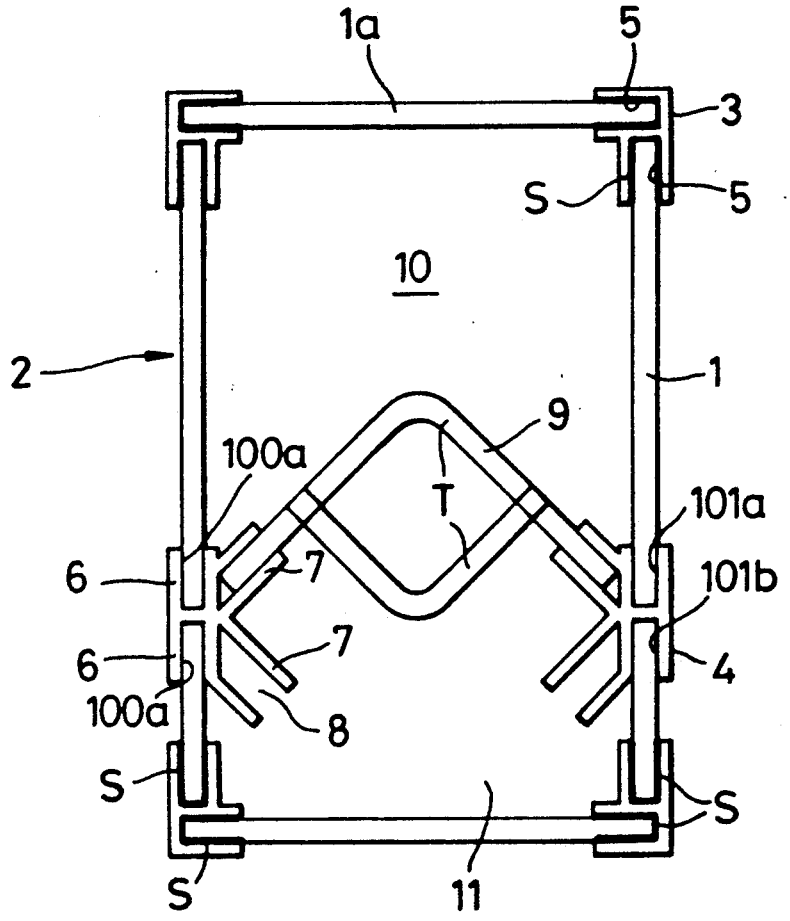
FIG. 1A is a similar drawing showing additional features according to the invention.

Referring to the drawing it will be seen that the linear cutting charge illustrated therein comprises a plurality of elongate planar members 1 in the form of strips of a suitable plastics material such as polyvinyl chloride, which has been assembled to form a box-like structure 2 using connecting means 3 and locating means 4.

The connecting means 3 each comprise angle pieces providing slots 5 extending at right angles to one another and adapted to tightly receive the adjacent side margins of adjacent planar members 1.

The locating means 4 are each substantially in the form of a letter K in cross-section and comprise opposed slots 6 for connecting two planar members 1 in edge-to-edge relation and rib means 7 at right angles to one another and each having a slot 8 therein. The slots 8 in each of the rib means of each locating means 4 is preferably of a different width as shown. The locating means 4 serve to locate a liner 9 which in the illustrated embodiment is in the form of a length of metal angle the side margins of which are engaged in the upper slots 8 of the locating means 4. If a thicker liner 9 is required then the locating means 4 are simply reversed and the wider slots 8 used to accommodate the side margins thereof.

The locating means 4 can also be used to locate a tubular liner which is either circular of square in cross-section. Such a tubular liner is located at each side by the angles formed by the rib means 7.

The liner 9 divides the box-like structure 2 into an upper space 10 for receiving an explosive material and a stand-off space 11. The liner 9 will produce high-velocity metal jets directed towards a target when explosive material in the space 10 is detonated in the manner of a conventional linear cutting charge. However, since the planar members 1, connecting means 3 and locating means 4 are all preferably formed from plastics material, there is less likelihood of dangerous fragments being produced thereby.

The box-like structure 2 can initially be assembled without the planar member 1*a* forming the top wall thereof and the space 10 filled with explosive material, e.g. a suitable plastics explosive material, prior to the planar member 1*a* being inserted in place. The assembled box-like structure 2 can be secured simply by wrapping adhesive tape therearound or placing elastic bands therearound or the margins of the planar members 1 can be secured in the slots 5 and 6 in any suitable manner as by bonding, welding or heat sealing. If the linear cutting charge is for use under water then it is preferred that the margins of the planar members 1 are sealingly secured in the slots 5 and 6 by means of a suitable adhesive.

The ends of the assembled box-like structure may be closed as by means of end caps and such end caps may have peripheral grooves therein for receiving the end margins of the planar members 1. The end caps may be sealingly secured to the ends of the box-like structure 2 as by means of an adhesive or the like. Such end caps may comprise plugs for closing the ends of a tubular liner. At least one of the end caps may also comprise means for locating a detonator, such as an aperture in the end cap through which a loop of detonating cord, formed by doubling over a length of detonating cord, can be inserted or a ribbed cylindrical passage for tightly receiving a cylindrical detonator.

Figure 1B:
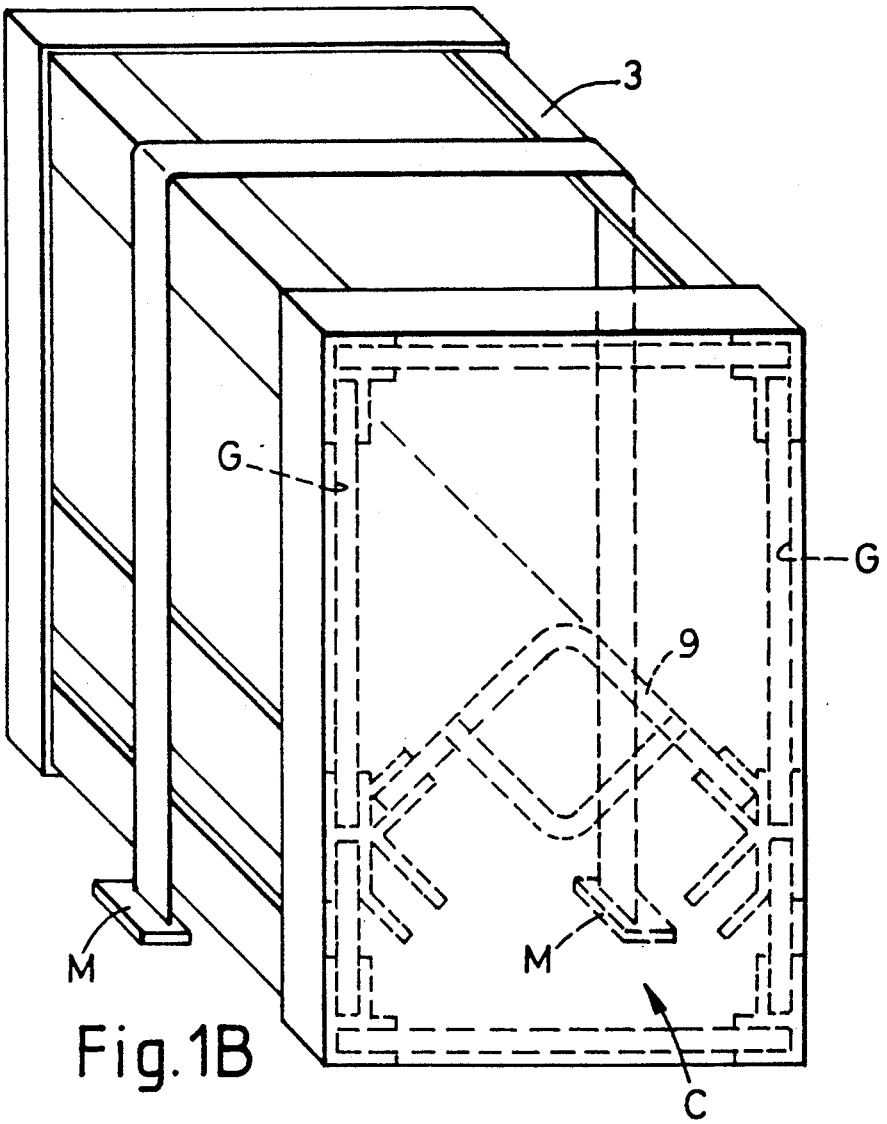
FIG. 1B is a perspective view showing an alternate embodiment of the invention.
Figure 1C:
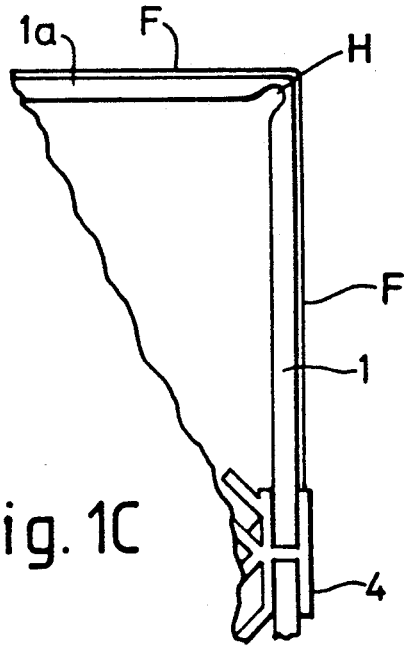
FIG. 1C is a view of a portion of a linear cutting charge assembly in accordance with an additional embodiment of the invention.

As shown in FIG. 1A, the side margins of the planar member 1 are sealingly secured in the slots 5 with a sealant S. Hollow tubular elements are designated as 100*a*, 100*b*, 101*a* and 101*b* in FIG. 1A. The closure means comprising end caps C and having peripheral grooves G are shown in FIG. 1B. The strap and associated magnet means constituting magnet M are shown in FIG. 1B. The planar member comprising at least one integral hinge H provided with a groove or apposed grooves in the planar member with the planar member having a plurality of parallel integral hinges with a substantially nonelastic film or foil F on both surfaces is shown in FIG. 1C.

It will readily be appreciated that with the kit-of-parts of the present invention, the various parts can be transported in a disassembled condition and therefore in a compact arrangement. Moreover, if the various parts are transported separately from the explosive material then the various parts are classified non-explosive and no special precautions need be taken. The planar members 1, connecting means 3, locating means 4 and liner 9 can be produced in any required length and can be cut to size as required either before assembly into the box-like structure 2 or before the explosive material is inserted into the space 10 of the box-like structure 2, thus avoiding the problems of the known types of linear cutting charge.

I claim:

1. A kit-of-parts for assembling to form a linear cutting charge, comprising a plurality of elongate planar members, means for connecting said planar members to form a box-like structure, a liner and means for locating said liner within said box-like structure to provide a space on one side of the liner for receiving an explosive material and a stand-off space on the other side of the liner, said locating means comprising rib means extending inwardly of the assembled box-like structure on opposite sides thereof.

2. A kit-of-parts according to claim 1, wherein said elongate planar members comprise strips of metal, wood or plastics material.

3. A kit-of-parts according to claim 1, wherin said connecting means comprise angle pieces formed integrally with a side margin of at least some of said planar members and adapted to engage an adjacent side margin of an adjacent planar member when forming said box-like structure.

4. A kit-of-parts according to claim 1, wherein said rib means extend inwardly of the box-like structure at an angle to one another.

5. A kit-of-parts according to claim 4, wherein said rib means are arranged at right angles to another.

6. A kit-of-parts according to claim 1, wherein said rib means comprise slots adapted to receive the side margins of an elongate angle-section liner.

7. A kit-of-parts according to claim 6, wherein said rib means comprise slots of different width for receiving elongate angle-section liners of different thickness.

8. A kit-of-parts according to claim 1, wherein said liner comprises an elongate angle-section element or a hollow tubular element.

9. A kit-of-parts according to claim 8, wherein said liner comprises an elongate right-angle-section element.

10. A kit-of-parts according to claim 8, wherein said liner comprises a hollow tubular element of round or square cross-section.

11. A kit-of-parts according to claim 1, wherein said locating means each comprise means for connecting two said planar members edge-to-edge.

12. A kit-of-parts according to claim 11, wherein said connecting means comprise a pair of opposed slots for receiving adjacent side margins of said two planar members.

13. A kit-of-parts according to claim 11, wherein each said locating means is substantially in the form of a letter K in cross-section.

14. A kit-of-parts according to claim 1, wherein at least one of said planar members comprises at least one integral hinge extending along the length thereof and providing said connecting means.

15. A kit-of-parts according to claim 14, wherein said integral hinge is provided by a groove or opposed grooves in said planar member which locally reduces the thickness of the planar member.

16. A kit-of-parts according to claim 14, wherein said planar member has a plurality of parallel integral hinges extending along the length thereof.

17. A kit-of-parts according to claim 16, wherein said planar member has a substantially non-elastic film or foil on one of both surfaces thereof which prevents the planar member folding about any of said integral hinges until the film or foil has been slit along a said integral hinge.

18. A kit-of-parts according to claim 1, comprising closure means for closing the ends of the assembled box-like structure.

19. A kit-of-parts according to claim 18, wherein said closure means comprise end caps.

20. A kit-of-parts according to claim 19, wherein each said end cap comprises peripheral grooves for receiving end margins of said planar members.

21. A kit-of-parts according to claim 19, wherein said end caps comprise plug portions for sealing the ends of a said tubular liner.

22. A kit-of-parts according to claim 1, comprising magnetic means for attaching the assembled linear cutting charge to a ferrous target.

23. A kit-of-parts according to claim 22, wherein said magnetic means comprises a strap having a permanent magnet at each end thereof, whereby the strap can be extended over the assembled linear cutting charge and the magnets attached to the target on either side of the linear cutting charge.

24. A kit-of-parts according to claim 23, wherein said strap is elastically resilient.

25. A kit-of-parts according to claim 23, wherein said strap is attachable to a top wall of the assembled box-like structure.

26. A kit-of-parts according to claim 1, wherein said connecting mean comprise angle pieces adapted to engage adjacent side margins of adjacent planar members when forming said box-like structure.

27. A kit-of-parts according to claim 26, wherein said angle pieces are elongate and are of length to extend over substantially the whole of the length of the planar members.

28. A kit-of-parts according to claim 26, wherein said angle pieces each comprise at least one slot adapted to receive a side margin of a said planar member.

29. A kit-of-parts according to claim 28, wherein said angle pieces each comprise two slots at right-angles to one another and adapted to receive the adjacent side margins of adjacent planar members.

30. A kit-of-parts according to claim 28, wherein said side margins of said planar members are a close fit in said slots.

31. A kit-of-parts according to claim 28, wherein said side margins of said planar members are sealingly securable in said slots.

32. A kit-of-parts according to claim 31, wherein said side margins of said planar members are sealingly securable in said slots by bonding, welding or heat-sealing.

33. A method of forming a linear cutting charge comprising the steps of forming a box-like structure by connecting together a plurality of elongate planar members, the structure being initially open at one side, locating a liner within said box-like structure by rib means extending inwardly of the box-like structure on opposite sides thereof to provide a space on one side of the liner adjacent said open side of the box-like structure and a standoff space on the other side of the liner, inserting explosive material into said space on said one side of the liner, and thereafter closing said open side of the box-like structure by a said planar member.

* * * * *